US008398830B2

(12) United States Patent
Son

(10) Patent No.: US 8,398,830 B2
(45) Date of Patent: Mar. 19, 2013

(54) METHOD AND SYSTEM FOR ANODIZING METALS

(75) Inventor: Chi Ho Son, Incheon (KR)

(73) Assignee: Samwon Altech Co., Ltd., Incheon (KR)

( * ) Notice: Subject to any disclaimer, the term of this patent is extended or adjusted under 35 U.S.C. 154(b) by 49 days.

(21) Appl. No.: 12/679,877

(22) PCT Filed: Jun. 4, 2009

(86) PCT No.: PCT/KR2009/002977

§ 371 (c)(1),
(2), (4) Date: Mar. 24, 2010

(87) PCT Pub. No.: WO2010/047456

PCT Pub. Date: Apr. 29, 2010

(65) Prior Publication Data

US 2011/0186438 A1 Aug. 4, 2011

(30) Foreign Application Priority Data

Oct. 20, 2008 (KR) ..... 10-2008-0102585

(51) Int. Cl.

| | |
|---|---|
| ***C25D 11/02*** | (2006.01) |
| ***C25D 11/04*** | (2006.01) |
| ***C25D 17/00*** | (2006.01) |
| ***C25B 9/00*** | (2006.01) |

(52) U.S. Cl. ..... 204/286.1; 204/288.1; 204/242; 205/108; 205/324

(58) Field of Classification Search ..... 205/324–332, 205/106–108; 204/286.1, 288.1
See application file for complete search history.

(56) References Cited

U.S. PATENT DOCUMENTS 3,079,308 A * 2/1963 Ramirez et al. ..... 205/139
4,189,360 A * 2/1980 Woods et al. ..... 205/145

* cited by examiner

*Primary Examiner* — Nicholas A Smith
*Assistant Examiner* — Brian W Cohen
(74) *Attorney, Agent, or Firm* — Kile Park Goekjian Reed & McManus PLLC

(57) ABSTRACT

Disclosed therein are a method and a system for anodizing metals. The anodizing system includes: an electrolytic bath storing electrolyte of a predetermined amount therein; an anode line mounted on an upper portion of the electrolytic bath, the anode line having insulation blocks for dividing the anode line into several sections; a cathode line disposed outside the anode line, the cathode line having insulation blocks mounted correspondingly to the insulation blocks of the anode line for dividing the cathode line into several sections; a chain connected to a driving sprocket and a driven sprocket inside the anode line, the chain having a plurality of transfer blocks; and hangers electrically connected to the anode line and adapted to fixe and support objects to be plated, which are deposited in the electrolyte.

4 Claims, 6 Drawing Sheets

METHOD AND SYSTEM FOR ANODIZING METALS

BACKGROUND OF THE INVENTION

1. Field of the Invention

The present invention relates to a method and a system for anodizing metals, and more particularly, to a method and a system for anodizing metals, which can form an anodic coating by anodizing the surface of metal, such as aluminum.

2. Background Art

In general, when metal or parts are connected to the anode in a dilute sulfuric acid electrolyte, it produces an anodic coating (Aluminum oxide, $Al_2O_3$) having a strong adhesion strength to a base metal by oxygen generated from the anode, and it is called "Anodizing". Anodizing is the compound word formed from the words "anode" and "oxidizing". Anodizing is different from the typical electroplating that metal parts are connected to the cathode for plating. The most representative material for anodizing is aluminum (Al), although processes also exist for magnesium (Mg), titanium (Ti), tantalum (Ta), hafnium (Hf), niobium (Nb), and so on. The recent trend is an increase in using the anodizing process of magnesium and titanium.

In case of anodizing on aluminum alloys, when aluminum is electrolyzed at the anode, half of the surface of aluminum is eroded and an anodized aluminum coating is formed on the rest of the surface of aluminum. The aluminum anodizing can form coatings of different properties according to the composition and density of electrolyte of various kinds, temperature, voltage and current of additives and electrolyte, and so on.

The anodized coating provides various effects as follows. The coating as a dense oxide provides improved corrosion resistance and improved decorative outward appearance. Moreover, the anodic coating provides increased surface hardness, improved wear resistance, improved coating adhesion, improved bonding performance and improved lubrication, allows unique colors for the purpose of decoration and preprocessing of plating, and also allows exploration of a surface damage.

Particularly, hard anodizing is a low temperature electrolysis that aluminum alloys are electrolyzed in an $H_2SO_4$ solution at low temperature (or room temperature), and it produces a thick coating more improved in corrosion resistance, wear resistance and insulation performance than coating of the general anodizing, and materials of at least more than 30 μm can be called hard materials. Hard anodizing is a method to convert the surface of aluminum metal into alumina ceramic using an electric-chemical anodizing method. Aluminum metal to which the above method is applied is oxidized and converted into alumina ceramic, and the anodized aluminum creates surface properties harder and stronger than steel and provides better corrosion resistance than hard chromium plating. Anodic coatings by hard anodizing does not come off like plating or painting (coating), and the surface of converted alumina ceramic provide improved insulation performance but electricity flows well inside the alumina ceramic. State-of-the-art technologies that hard-anodizing process is applied to such aluminum metals have been developed and applied.

As described above, in order to apply hard-anodizing to the aluminum metals, aluminum metal is deposited in an electrolytic bath storing electrolyte of an acid solution, and then, voltage and current are applied thereto to thereby form an oxide coating on the metal surface. In this instance, thickness is varied according to intensity of voltage and current applied to the electrolytic bath.

In order to increase coating thickness of aluminum metals, conventionally, aluminum metal is deposited in an electrolytic bath, to which low voltage and low current are applied. After a coating of a predetermined thickness is formed on the aluminum metal, the aluminum metal is moved to another electrolytic bath, to which relatively high voltage and current are applied, to form a thick coating. That is, conventionally, a plurality of electrolytic baths, to which different voltages and currents are applied, are prepared, and then, the aluminum metal is deposited in corresponding electrolytic baths in due order to increase the coating thickness.

Accordingly, the conventional methods and systems for anodizing metals have several problems in that they need a number of electrolytic baths and additional devices in order to increase the coating thickness of aluminum metals, and in that it requires a lot of manpower, expenses and time for the anodizing process.

SUMMARY OF THE INVENTION

Accordingly, the present invention has been made to solve the above-mentioned problems occurring in the prior arts, and it is an object of the present invention to provide a method and a system for anodizing metals, that a plurality of sections to which different voltages and currents are applied are formed in a single electrolytic bath and metals to be anodized are rotated by sections, thereby obtaining a wanted coating thickness.

To accomplish the above object, in one aspect of the present invention, there is provided a system for anodizing metals comprising: an electrolytic bath storing electrolyte of a predetermined amount therein; an anode line mounted on an upper portion of the electrolytic bath, the anode line having insulation blocks for dividing the anode line into several sections; a cathode line disposed outside the anode line, the cathode line having insulation blocks mounted correspondingly to the insulation blocks of the anode line for dividing the cathode line into several sections; a chain connected to a driving sprocket and a driven sprocket inside the anode line, the chain having a plurality of transfer blocks; and hangers electrically connected to the anode line and adapted to fixe and support objects to be plated, which are deposited in the electrolyte.

In another aspect of the present invention, there is provided a method of anodizing metals comprising the steps of: (a) putting hangers, to which a plurality of objects to be plated are fixed, on a holder being in contact with an anode line divided by insulation blocks into several sections, and depositing the objects in electrolyte; (b) applying power supply to anode plates and cathode plates by a power control panel to thereby carry out anodizing of the objects deposited in the electrolyte; (c) driving a motor by the power control panel to thereby rotate a chain saw-toothed coupled to a driving sprocket and a driven sprocket; (d) inhaling and emitting gases generated in the electrolyte during the anodizing through ducts mounted on a suction fan; and (e) separating the completely anodized objects from the electrolytic bath.

As described above, the present invention can carry out hard-anodizing of the objects to a wanted thickness of coating in a single electrolytic bath at a time, whereby the present invention can carry out the anodizing process within a short period of time, reduce manpower and expenses required for the anodizing process, and provide anodized metals of good quality.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will be now made in detail to a method and a system for anodizing metals according to the present invention with reference to the attached drawings.

Figure 1:
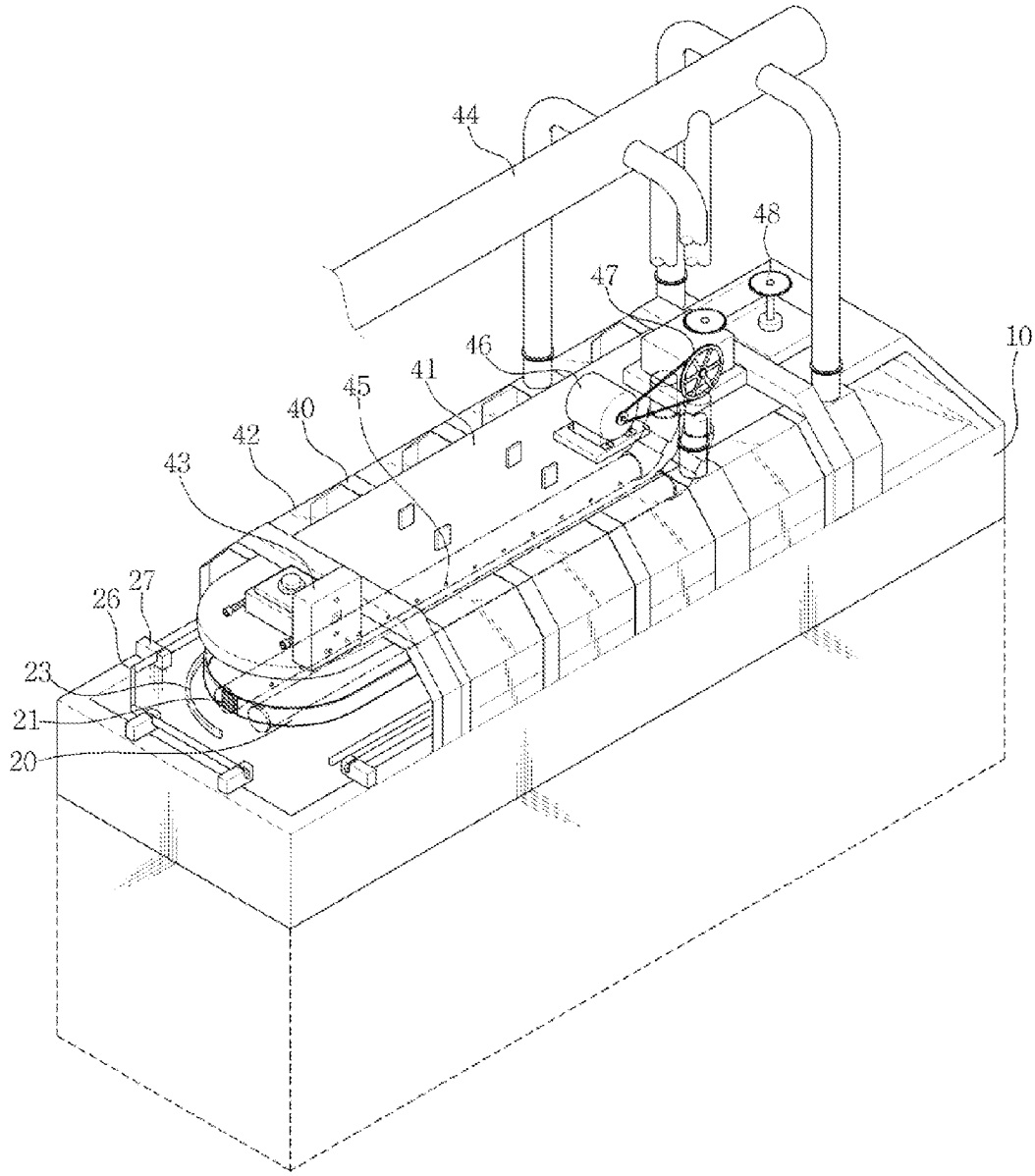
FIG. 1 is a perspective view of a system for anodizing metals according to the present invention.
Figure 2:
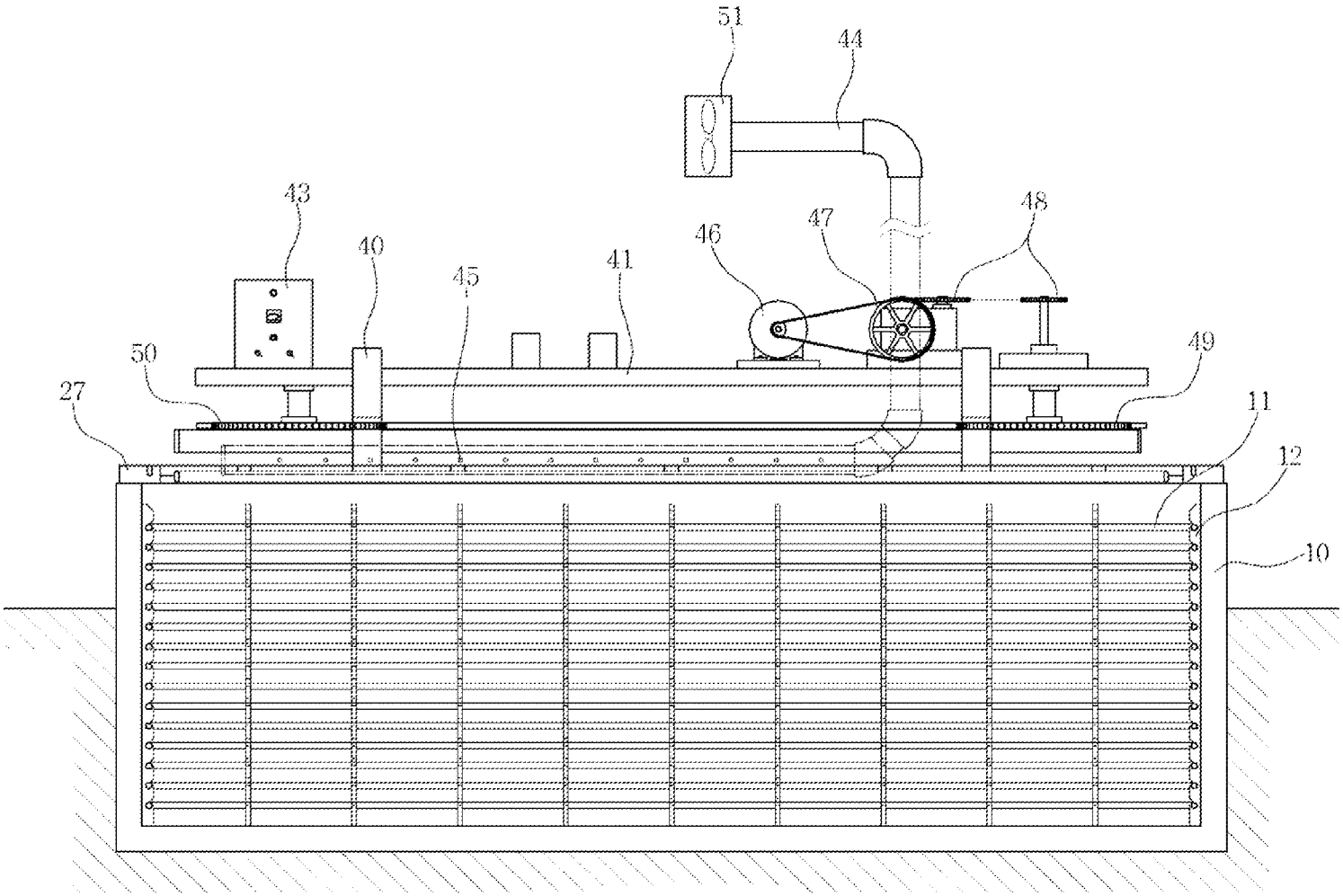
FIG. 2 is a cross-sectional view of the system for anodizing metals according to the present invention.
Figure 3:
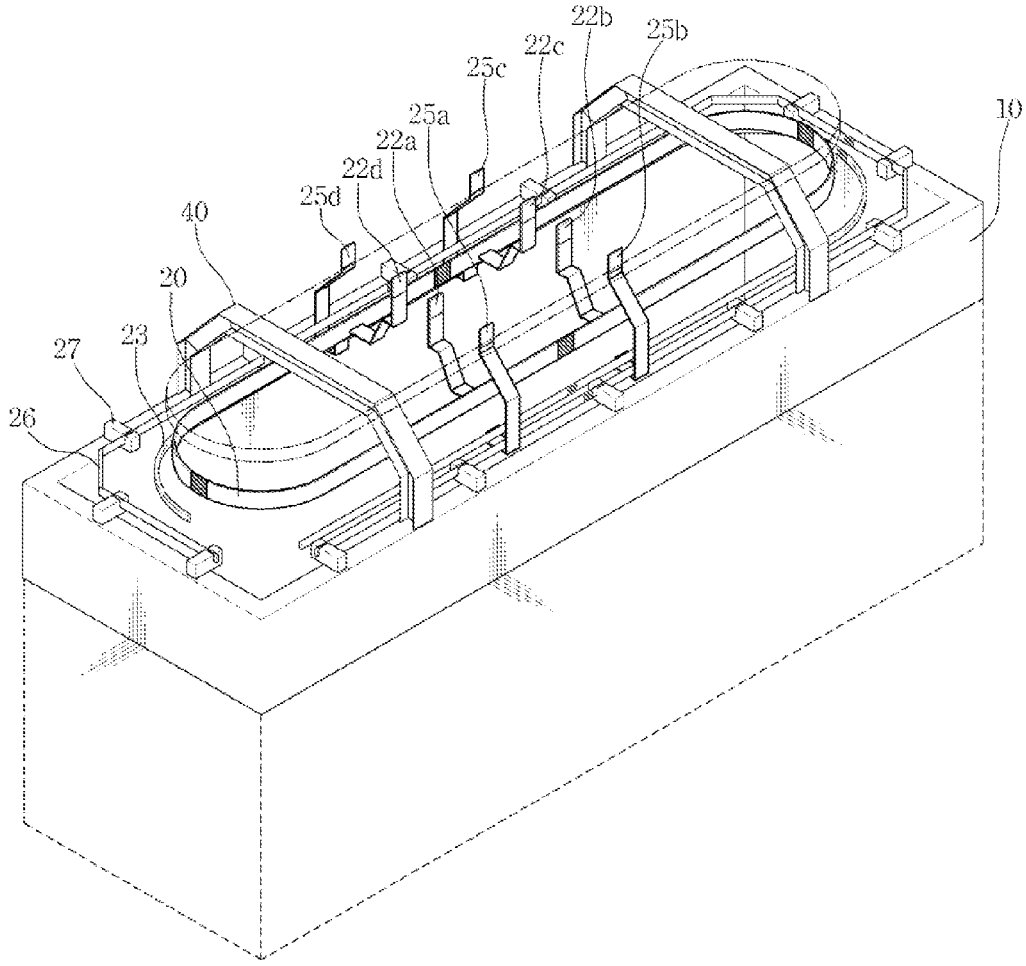
FIG. 3 is a plan sectional view of the system for anodizing metals according to the present invention.

FIG. 1 is a perspective view, FIG. 2 is a cross-sectional view and FIG. 3 is a plan sectional view of the system for anodizing metals according to the present invention.

First, the metal anodizing system according to the present invention is to coat the surface of metals through the anodizing process. According to the present invention, electric voltage and current of different kinds are applied from one electrolytic bath to thereby obtain a wanted coating thickness of an object to be plated.

The electrolytic bath 10 stores an electrolyte of a predetermined amount. It is preferable that the electrolytic bath 10 is made of a material, which is not oxidized by the electrolyte or can insulate an applied power supply from the outside, and has a predetermined strength. Furthermore, on an inner wall of the electrolytic bath 10, cooling pipes 12 for sending and receiving cooling water or refrigerant for cooling of the electrolyte are fixed via a fixing member 11. That is, the cooling pipes 12 are inserted and fixed in grooves formed on the fixing member 11 at predetermined intervals to thereby maintain a constant temperature of the electrolyte, so that hard anodizing can be applied to the surface of metal at low temperature or at room temperature.

An anode line 20 is mounted on an upper portion of the electrolytic bath 10 and insulation blocks 21 are joined thereto for dividing the anode line 20 into certain sections. The anode line 20 is a close loop band with conductivity. For example, referring to FIG. 3, the anode line 20 is divided into four parts by the insulation blocks 21*a* to 21*d*. Electric voltage and current are applied to the four divided anode lines 20*a* to 20*d*. The insulation blocks 21 are made of synthetic resin material, and nonconductors for maintaining an insulating state from the anode line 20 adjacent to the insulation blocks 21. A holder 30 is in face-to-face contact with the anode line 20. That is, an upper portion of the holder 30 is bended and put on an upper end of the anode line 20. Accordingly, the holder 30 is rotated along the anode line 20 by transfer blocks 29 in face-to-face contact with the anode line 20. Hooks formed on upper portions of hangers 32 are hung on a hanging portion formed on both sides of a lower portion f the holder 30.

The hangers 32 are electrically connected to the anode line 20 and fixes and supports an object 33 to be plated, which is deposited in the electrolyte. Each of the hangers 32 includes the hook formed on the upper portion thereof and a plurality of fixing members formed on a lower portion thereof for fixing the object 33 to be plated. The fixing members may be formed in various structures according to shapes or forms of the object 33 to be plated. The hanger 32 is a conductor, and it is preferable that it is made of a conductive material, such as copper (Cu).

A cathode line 23 is arranged outside the anode line 20 and includes insulation blocks 24 joined thereto at positions corresponding to the insulation blocks 24 of the anode line 20 to thereby divide the cathode line 23 into certain sections. The cathode line 23 is an open loop band with conductivity. For instance, referring to FIG. 3, the cathode line 23 is divided into four cathode lines 23*a* to 23*d* by insulation blocks 24*a* to 24*c*. The insulation blocks 24 are made of synthetic resin material, and nonconductors for maintaining an insulating state from the cathode lines 23*a* to 23*d* adjacent to the insulation blocks 24*a* to 24*c*. The cathode line 23 is supported by a support line 26 fixed on fixing blocks 27 fixed on an upper end of the electrolytic bath 10 at regular intervals. That is, a plurality of the fixing blocks 27, which are insulators, are fixed on the electrolytic bath 10, the support line 26 is fixed on the fixing blocks 27, cathode plates 25*a* to 25*d* are joined to the support line 26, and the cathode line 23 is joined to the cathode plates 25*a* to 25*d*. Also the support line 26 is divided by insulation blocks 34*a* to 34*c* located in correspondence with the insulation blocks 24*a* to 24*c* of the cathode line 23. The fixing blocks 27 are made of synthetic resin material, and nonconductors for maintaining an insulating state from the electrolytic bath 10. Moreover, a conduction band 31 is put between the cathode line 23 and the support line 23, and a lower portion of the conduction band 31 is deposited in the electrolyte. That is, the hangers 32 connected to the anode line 20 and the conduction band 31 connected to the cathode line 23 carry out electrical oxidation and reduction reaction in the electrolyte.

A chain 28 is joined to a driving sprocket 49 and a driven sprocket 50 inside the anode line 20, and a plurality of transfer blocks 29 are mounted thereon. The chain 28 rotates in a predetermined direction via a rotational force of the driving sprocket 49, and the transfer blocks 29 are fixed thereon at regular intervals. Additionally, the transfer blocks 29 are made of insulating material, and push the holder 30 of the anode line 20, so that the holder 30 rotates along the anode line 20. That is, when the chain 28 is rotated by the driving sprocket 49 and the driven sprocket 50, the transfer blocks 29 fixed on the chain 28 push the holder 30, whereby the hangers 32 can move inside the electrolytic bath 10.

The rotational force generated from the driving sprocket 49 is transferred from a motor 46, which is driven by a power supply applied from a power control panel 43, through a reducer 47 and a power transmission member 48. The motor 46 is mounted on an upper plate 41 mounted on the upper portion of the electrolytic bath 10. The upper plate 41 is fixed by a plurality of support frames 40 mounted on the upper portion of the electrolytic bath 10. A transparent cover 42 is mounted between the support frames 40 in order to allow a worker to monitor the inside of the electrolytic bath 10, to allow the hangers 32 to be put on the holder 30, or to prevent emission f gases generated from the electrolyte in the electrolytic bath 10 to the outside.

Figure 4:
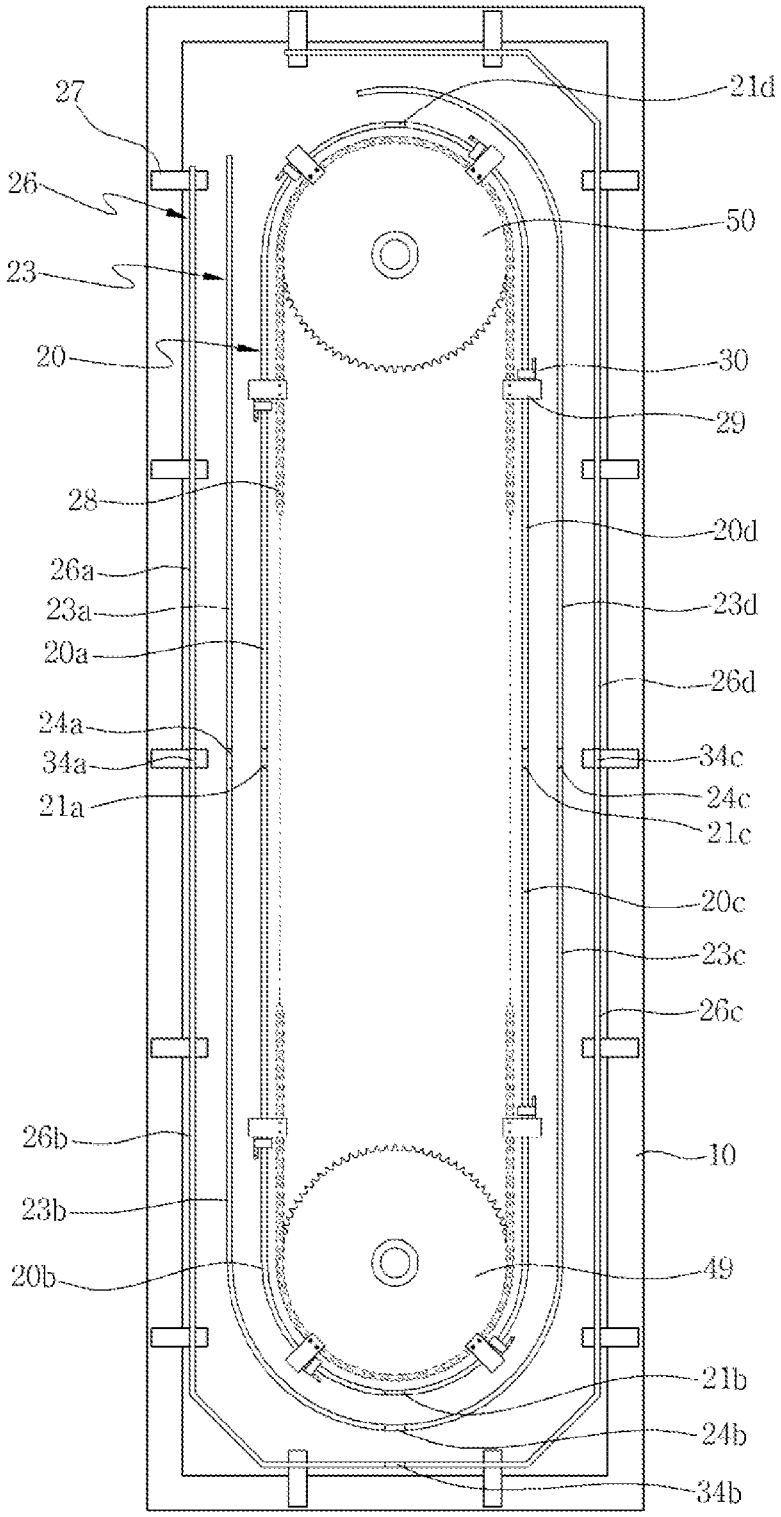
FIG. 4 is a perspective view showing a state where an anode plate and a cathode plate are respectively connected to an anode line and a cathode line of the system for anodizing metals according to the present invention.
Figure 5:
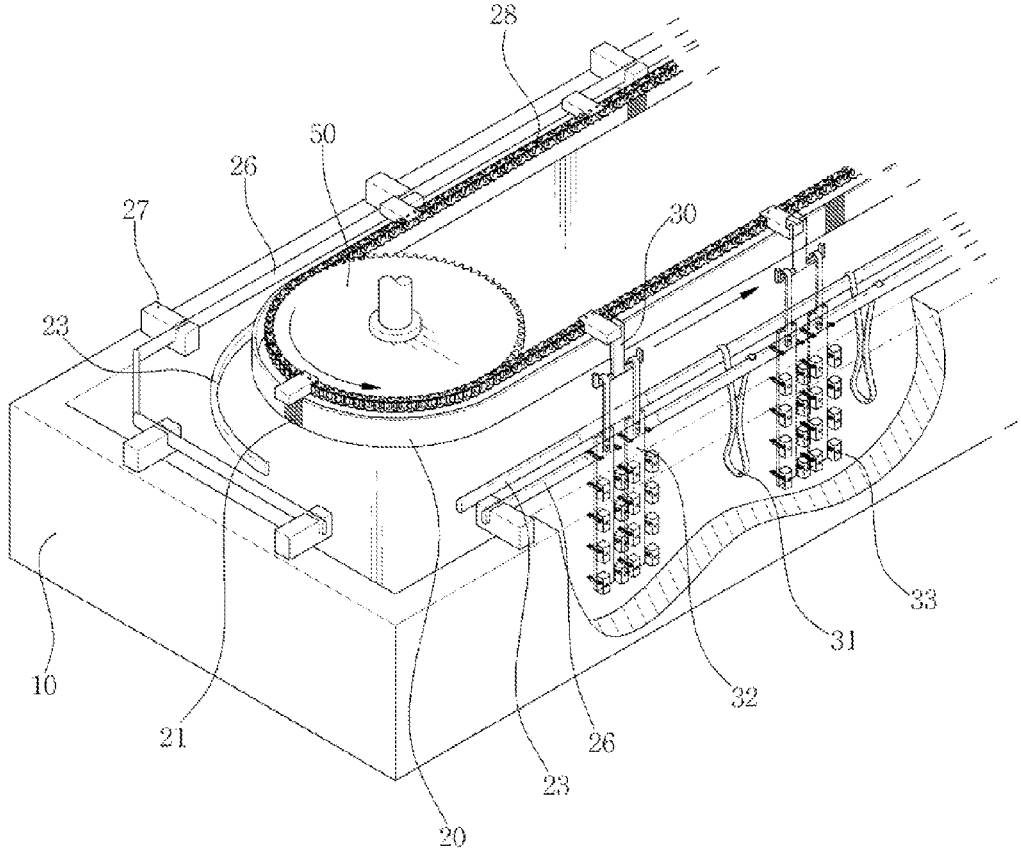
FIG. 5 is a partially enlarged view showing an operation of the system for anodizing metals according to the present invention.
Figure 6:
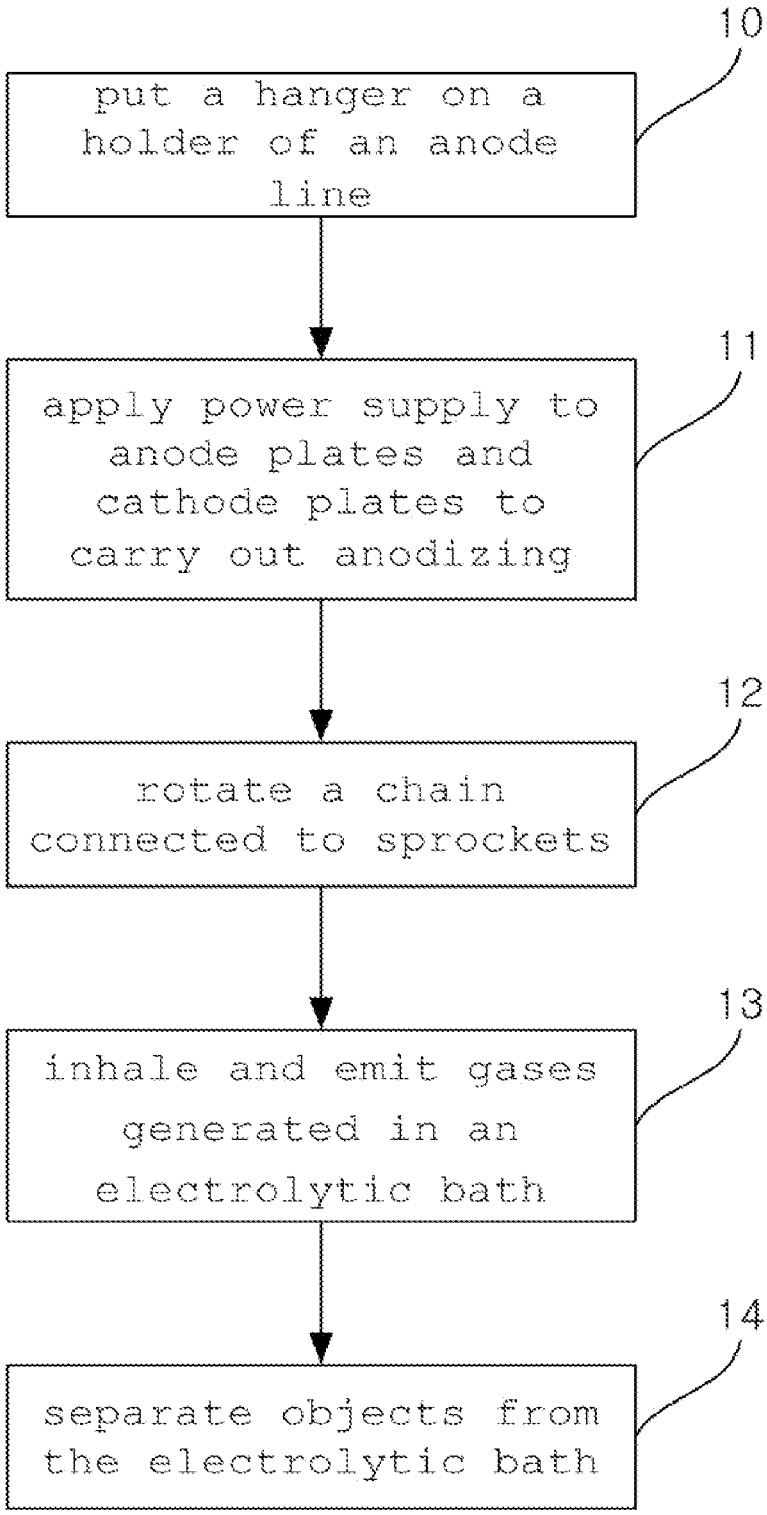
FIG. 6 is a flow chart showing a method of anodizing metals according to the present invention.

Referring to FIG. 4, anode plates 22*a* to 22*d*, to which electric power supplied from the power control panel 43 is applied, are joined to corresponding sections of the anode lines 20*a* to 20*d* divided into several sections, and cathode plates 25*a* to 25*d*, to which electric power supplied from the power control panel 43 is applied, are joined to corresponding sections of the cathode lines 23*a* to 23*d* divided into several sections. That is, the anode plates 22*a* to 22*d* and the cathode plates 25*a* to 25*d* are respectively joined to the anode lines 20*a* to 20*d* and the cathode lines 23*a* to 23*d*, which are divided by the insulation blocks 21*a* to 21*d* and 24*a* to 24*c*, at their corresponding positions.

The power control panel 43 supplies and controls voltage, current and power supply of different kinds applied to the corresponding anode plates 22*a* to 22*d* and the corresponding cathode plates 25*a* to 25*d*. Moreover, the power control panel 43 supplies electric power necessary for driving the motor 46 and electric power necessary for driving a suction fan 51. Accordingly, the power control panel 43 supplies and controls all power supplies necessary for operating the electrolytic bath 10.

Furthermore, the motor 46 is driven by the power supply applied from the power control panel 43, a rotational speed of the motor 46 is reduced by the reducer 47 connected to a rotating shaft of the motor, and a rotational force of the reducer 47 is transferred to the driving sprocket 49 through the power transmission member 48 to thereby rotate the chain 28.

A duct 44 having a plurality of suction holes 45 is disposed between a lower portion of the upper plate 41 and the upper portion of the electrolytic bath 10. The duct 44 is mounted to inhale gases generated in the electrolytic bath 10 through the plural suction holes 45 by the driving of the suction fan 51 and emit them to the outside. A plural number of the ducts 44 are mounted to emit gases to the outside.

Now, a method of anodizing metals by the metal anodizing system according to the present invention will be described referring to FIGS. 1 to 5 and FIG. 6.

First, the hangers 3 hanging a plurality of objects 33 to be plated are put on the holder 30 mounted on the anode line 20 mounted on the upper portion of the electrolytic bath 10 in such a way that the objects 33 to be plated are deposited in the electrolyte in the electrolytic bath 10 (S10). In this instance, the transparent cover 42 is opened, so that the hangers 32 can be put on the holder 30. Furthermore, the hangers 32 can be put on the anode lines 20*a* to 20*d*, which are divided in the certain sections by the insulation blocks 21*a* to 21*d*. Alternatively, after the hanger 32 is put on the first anode line 20*a*, when the hanger put on the first anode line 20*a* passes the whole of the first anode line 20*a* and enters the second anode line 20*b*, anther hanger 32 is put on the first anode line 20*a*.

In addition, the power control panel 43 applies power supply to the anode plates 22*a* to 22*d* and the cathode plates 25*a* to 25*d* to thereby anodize the objects 33 deposited in the electrolyte. (S11). In this instance, the power control panel 43 applies different voltage and current to the anode plates 22*a* to 22*d* and the cathode plates 25*a* to 25*d* connected to the divided anode lines 20*a* to 20*d*. For instance, the power control panel 43 applies 10V to the first anode line 20*a*, 20V to the second anode line 20*b*, 30V to the third anode line 20*c*, and 40V to the fourth anode line 20*d*. Namely, intensity of applied voltage or current is varied according to the objects 33 to be plated or according to a wanted coating thickness of the objects 33.

Next, the power control panel 43 actuates the motor 46 to thereby rotate the chain 28 saw-toothed coupled to the driving sprocket 49 and the driven sprocket 50 (S12). That is, the transfer blocks 29 push the holder 30 of the anode line 20 to be rotated while being rotated. In this instance, the rotation speed of the chain 28 determines a period of time for oxidation and reduction of the objects 33 in the electrolyte.

Moreover, the anodizing process of metals according to the present invention can increase the coating thickness of the objects 33 more while the objects passes the second anode line 20*b* after the coating thickness of the objects 33 is determined by a predetermined voltage or current in the first anode line 20*a*, and the coating thickness of the objects 33 can increase more while the objects pass along the third and fourth anode lines 20*c* and 20*d* or other anode lines, which may be added more. Accordingly, the coating thickness of the objects 33 can be increased or decreased according to the number of anode lines 20 and cathode lines 23 corresponding to the anode lines 20 and according to intensity of the power supply applied thereto.

Additionally, gases generated by oxidation and reduction in the electrolyte during anodizing of the objects 33 to be plated are inhaled through the suction holes 45 of the duct 44, on which the suction fan 51 is mounted, and emitted through the plural ducts 44 to the outside (S13).

While the anodizing process of the objects 33 is carried out in the electrolyte of the electrolytic bath 10, the chain 28 travels around the electrolytic bath 10, and then, separates the completely anodized objects 33 from the electrolytic bath 10 (S14). Namely, when the objects 33 rotates the anode line 20 once or more by the rotation of the chain 28, the hangers put on the holder 30 are separated from the holder 30 and took out of the electrolytic bath 10, whereby the anodizing process of metals is finished.

Differently from the conventional anodizing method that objects to be plated are deposited in a plurality of electrolytic baths in order for the purpose of anodizing process, The metal anodizing method according to the present invention can carry out the anodizing process at a time along the divided anode lines and the divided cathode lines in one electrolytic bath.

While the present invention has been described with reference to the particular illustrative embodiment, it is not to be restricted by the embodiment but only by the appended claims. It is to be appreciated that those skilled in the art can change or modify the embodiment without departing from the scope and spirit of the present invention.

What is claimed is:

1. A system for anodizing metals comprising:

an electrolytic bath storing electrolyte of a predetermined amount therein;

an anode line mounted on an upper portion of the electrolytic bath, the anode line having insulation blocks for dividing the anode line into several sections and anode plates joined between the insulation blocks for supplying electric power;

a cathode line disposed outside the anode line, the cathode line having insulation blocks and cathode plates, the insulation blocks being mounted correspondingly to the insulation blocks of the anode line for dividing the cathode line into several sections, the cathode plates being joined between the insulation blocks for supplying electric power;

a driving sprocket and a driven sprocket mounted inside the cathode line, the driving sprocket and the driven sprocket being separated from each other at a predetermined interval;

a chain connected to the driving sprocket and the driven sprocket for transferring a rotational force of the driving sprocket to the driven sprocket;

transfer blocks rotating along the anode line by the rotation of the chain;

hangers electrically connected to the anode line for fixing and supporting objects to be plated, which are deposited in the electrolyte;

a support line fixed on fixing blocks, which are fixed on an upper end of the electrolytic bath at predetermined intervals, for supporting the cathode line fixed on the cathode plates through the cathode plates; and a conduction band put between the cathode line and the support line and deposited in the electrolyte.

2. The anodizing system according to claim 1, further comprising:

an upper plate fixed on the upper portion of the electrolytic bath by a plurality of support frames;

a transparent cover mounted between the support frames for monitoring the inside of the electrolytic bath and preventing emission of gases to the outside;

a motor adapted for generating a rotational force by power supply applied from a power control panel mounted on an upper portion of the upper plate;

a reducer connected to a rotating shaft of the motor for reducing a rotational speed;

a power transmission member for transmitting the rotational force of the reducer to the driving sprocket; and ducts adapted to inhale gases, which are generated in the electrolytic bath, through a plurality of suction holes by the driving of a suction fan and to emit them to the outside.

3. The anodizing system according to claim 2, further comprising:

a cooling pipe fixedly mounted on an inner wall of the electrolytic bath via fixing members for cooling the electrolyte.

4. The anodizing system according to claim 1, further comprising:

a holder being in face-to-face contact with the anode line and rotating along the anode line by the transfer blocks in a state where the hangers are put thereon.

* * * * *